US007377665B2

(12) United States Patent
Langenwalter

(10) Patent No.: US 7,377,665 B2
(45) Date of Patent: May 27, 2008

(54) BUCKLE-MOUNTED LIGHT

(76) Inventor: Keith Allan Langenwalter, 7740 SW. Barnes Rd., Unit D, Portland, OR (US) 97225

( * ) Notice: Subject to any disclaimer, the term of this patent is extended or adjusted under 35 U.S.C. 154(b) by 0 days.

(21) Appl. No.: 11/625,760

(22) Filed: Jan. 22, 2007

(65) Prior Publication Data

US 2007/0171629 A1 Jul. 26, 2007

Related U.S. Application Data

(60) Provisional application No. 60/760,334, filed on Jan. 20, 2006.

(51) Int. Cl.
*F21W 121/06* (2006.01)

(52) U.S. Cl. ..... 362/103; 362/108
(58) Field of Classification Search ..... 362/103, 362/108
See application file for complete search history.

(56) References Cited

U.S. PATENT DOCUMENTS

| | | | | |
|---|---|---|---|---|
| 4,283,756 | A | 8/1981 | Beamon | |
| 4,849,863 | A | 7/1989 | Gallegos | |
| 5,045,979 | A | 9/1991 | Stevens | |
| 5,183,324 | A | 2/1993 | Thomas | |
| 5,255,168 | A | 10/1993 | Stevens | |
| 5,359,501 | A | 10/1994 | Stevens | |
| 5,438,492 | A * | 8/1995 | Collins et al. | 362/108 |
| 6,056,412 | A | 5/2000 | Atlee et al. | |
| 6,150,950 | A * | 11/2000 | Shen Liu | 340/815.42 |
| 6,499,859 | B2 | 12/2002 | Petzl et al. | |
| 6,979,098 | B2 | 12/2005 | Petzl et al. | |
| 2006/0056175 | A1 | 3/2006 | Petzl et al. | |

* cited by examiner

*Primary Examiner*—Laura Tso

(57) ABSTRACT

A belt buckle with an embedded power source, such as battery(s), and an attached or embedded light source, such as light emitting diodes, for illuminating an area in front of a user, such as a hiker, climber, or trail-runner. The buckle is typically a side-release plastic buckle, and is typically mounted centrally on a pack's hip-belt. The light is adjustable vertically, or has a lens to produce a tall, narrow beam of light for the purpose of illuminating a large section of trail.

20 Claims, 10 Drawing Sheets

BUCKLE-MOUNTED LIGHT

CROSS-REFERENCE TO RELATED APPLICATIONS

This application claims the benefit of provisional patent application Ser. No. 60/760,334, filed 2006 Jan. 20 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to lighting devices, specifically to hands-free devices used to illuminate a user's path.

2. Prior Art

Hikers, climbers, and trail-runners use artificial light to illuminate the trail at night. The introduction of the headlamp allowed hands-free operation of the lighting device, freeing their hands to operate other objects and devices, also minimizing the chance of dropping the lighting device.

However, headlamps have disadvantages. The light is located close to the user's eyes. The shadows cast by objects in the user's path are hidden by the objects themselves. This yields a lack of depth perception, making travel more difficult.

Another disadvantage of locating a light source on a user's head is apparent in cool weather. When a user exhales, the moisture from the user's breath is sharply illuminated. This momentarily blinds the user. This is also detrimental to the user's night-vision.

Headlamps are often bulky and cumbersome. Many people do not like objects on their heads. These users will avoid using headlamps.

These issues are not present with hand-held lights, however, these lights are not hands-free. A user is unable to use trekking poles or other items when using a hand-held light. Also, the natural motion of moving one's arms when walking or running must be stifled. A user is forced to hold the light, which can then be dropped. The user is also unable to put their hands in their pockets, thereby warming them.

One solution for this is a light with a clip. A light with a clip is hands-free, and does not have the same problems as a headlamp; however, its function is limited as well. A clip can be placed in many locations, but cannot be attached at the center of a backpack's hip-belt, as the buckle is there. If the buckle is placed off-center to accommodate a light clipped to the center of the belt, the buckle will be where padding usually is. This requires a hip-belt to have less padding, which decreases a user's comfort.

In addition, a light with a clip, a headlamp and a handheld light can be misplaced, and can be difficult to find when darkness is approaching. They can be buried deep in a pack, or worse, either forgotten at home, or lost on the trail.

Others have come to the conclusion of mounting a light on a user's waist. U.S. Pat. No. 4,849,863 (Gallegos, 1989), U.S. Pat. No. 5,045,979 (Stevens, 1991), U.S. Pat. No. 5,255,168 (Stevens, 1993), U.S. Pat. No. 5,359,501 (Stevens, 1994), and U.S. Pat. No. 6,056,412 (Atlee et al., 2000) all address this issue. All of these patents require a separate device from what a hiker would ordinarily carry, and are largely incompatible with a pack hip-belt. U.S. Pat. No. 4,283,756 (Beamon, 1981), attaches a light to a buckle, but the light flashes and is used solely for safety and not for illumination. It does not illuminate a user's path, and the batteries are in a separate housing, not even attached to the belt. U.S. Pat. No. 5,183,324 (Thomas, 1993) and U.S. Pat. No. 6,499,859 B2 (Petzl et al., 2002) describe a lamp with batteries built in, but it's a single housing, not a buckle of any kind. Finally, U.S. Pat. No. 6,979,098 B2 (Petzl et al., 2005) and U.S. patent application 2006/00561758 A1 (Petzl et al., filed Jan. 28, 2004) describe a swiveling optic system. These describe a binary system, it is either on or off; it is not used to direct a beam of light depending on the angle of the optics.

OBJECTS AND ADVANTAGES

Accordingly, several objects and advantages of the present invention are:

a) to provide a light formed into a hip-belt buckle, of which hikers and climbers ordinarily have with them.

b) to provide a light that is a significant distance from the users eyes, so shadows of objects in the trail are visible.

c) to provide a light that is a significant distance from the mouth and nose, so it will not illuminate the condensation in user's breath in cooler weather; this will prevent temporarily blinding the user.

d) to provide a hands-free light that does not have straps around or object(s) on the user's head.

e) to provide a light that is centered on the user's belt, and thus centered with a user's line of sight.

f) to provide a light which cannot get separated from the pack unintentionally, therefore making it more difficult to lose; the user will always know where the light is located.

g) to provide a light that has either a specific LED arrangement or a lens provided so a wide section of the trail or area in front of the user is illuminated.

Further objects and advantages will become apparent from a consideration of the ensuing description and drawings.

SUMMARY

There is a need for a light source for illuminating a trail with hand free operation and providing a significant distance between a user's eyes and the light source. There is also a need for a light source that is attached to, in other words affixed to or integral with, a belt buckle on a pack.

These needs and others are met by embodiments of the present invention, which comprise a portable light constructed of a light housing attached, either embedded or with a hinge, to a belt buckle, such as a side-release plastic buckle, with a power source, such as a battery(s), embedded within the buckle.

Additional advantages and novel features of the invention will be set forth in part by the description which follows, and in part will become apparent to those skilled in the art upon examination of the following or may be learned by practice of the invention. The advantages of the invention may be realized and attained by the instrumentalities and combinations, particularly pointed out in the appended claims.

BRIEF DESCRIPTION OF THE DRAWINGS

The present invention is illustrated by way of example, and not by way of limitation in the figures of the accompanying drawings in which like reference numerals refer to similar elements and in which.

DRAWINGS—REFERENCE NUMERALS

Figure 1A:
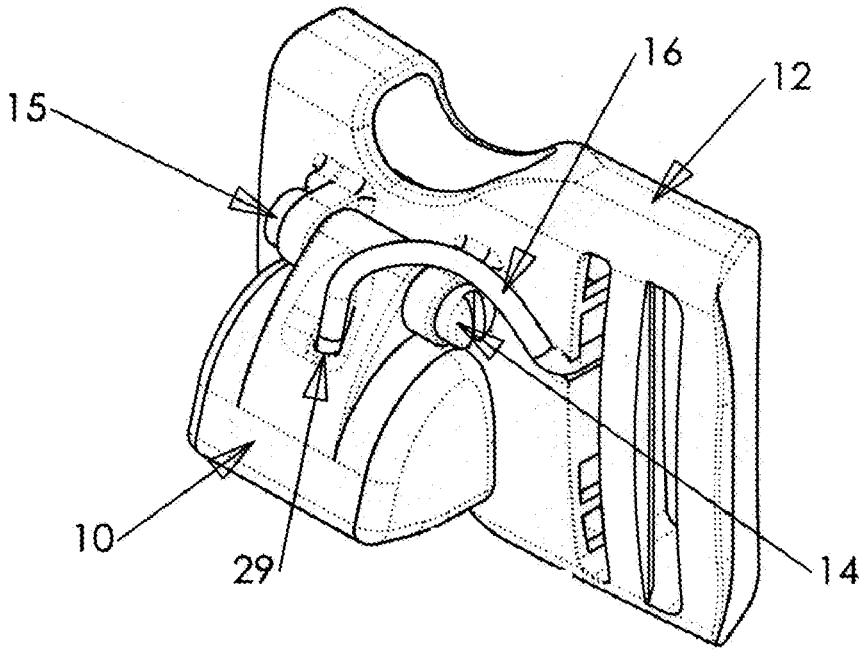
FIG. 1*a* shows an isometric view of a light in a stowed position.
Figure 1B:
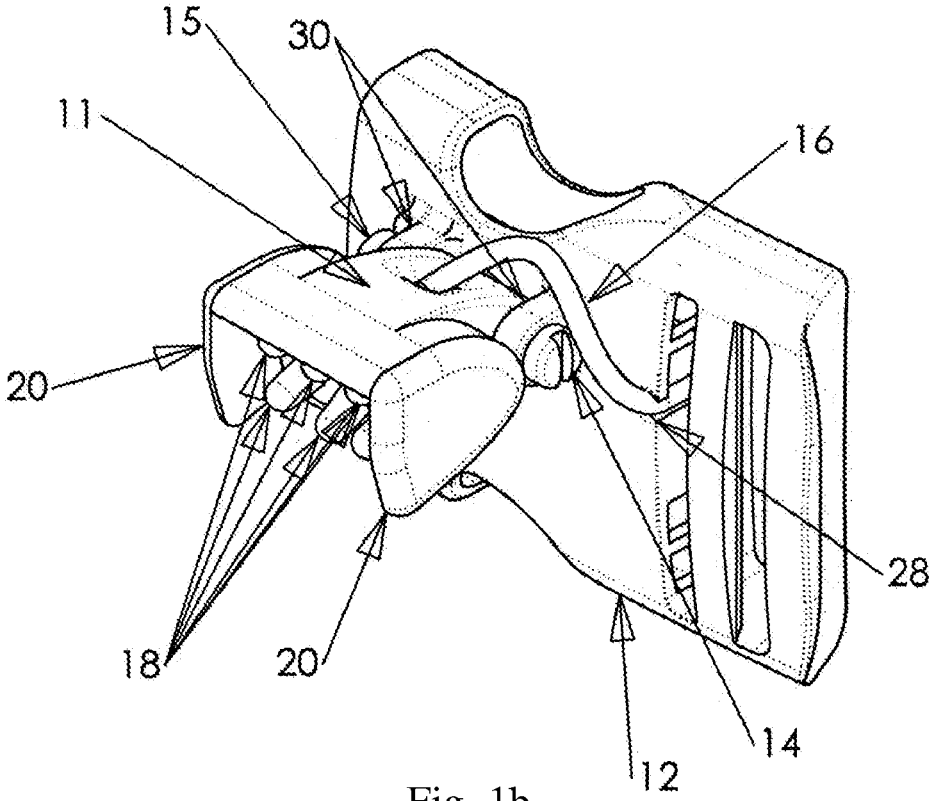
FIG. 1*b* shows an isometric view of the light of FIG. 1*a* in an "in-use" position.

| | |
|---|---|
| 10 | Housing Assembly |
| 11 | Housing body |
| 12 | Female Side-release buckle |
| 14 | Bolt |
| 15 | Nut |
| 16 | Cable |
| 18 | 5 mm LED |
| 19 | Hole (switch) |
| 20 | Side Panel |
| 21 | Opaque protrusion |
| 22 | Switch |
| 23 | Button |
| 24 | Circuit Board |
| 26 | Front Panel |
| 27 | Hole |
| 28 | Groove |
| 29 | Hole |
| 30 | Mounting Posts |
| 31 | Protrusion (nut) |
| 32 | Recess (button) |
| 34 | Cavity |
| 36 | AAA Battery |
| 38 | 1W LED |
| 40 | Battery Cover |
| 42 | Male Buckle |
| 43 | Plain Female Buckle |
| 46 | Embedded Housing Buckle |
| 48 | Swivel Housing Buckle |
| 49 | Swivel Housing |
| 50 | Swivel Lens Buckle |
| 51 | Swivel Lens |
| 52 | Adapter Buckle |

DETAILED DESCRIPTION

The present invention addresses and solves problems related to light sources, particularly where current light sources do not provide ample space between a user's eyes and the light source to allow user easily discern objects and the shadows they cast at night. The present invention also addresses and solves problems related to providing a light source which is integrated into a pack, specifically a buckle, and permits hands free operation.

The present invention solves the above problems by providing a light as discussed below. One of ordinary skill in the art will realize that the following discussion is illustrative and intended to describe preferred embodiments of the present invention and is not intended to limit the present invention to the embodiments discussed. The present invention has numerous applications where a light is needed for hands free operation. The present invention may be scaled and adapted to many applications and is defined by the claims, which set forth the metes and bounds of the present invention.

Referring now to the drawings, and initially to FIGS. 1-5, the preferred embodiment of the light of the present invention is described. FIG. 1*a* shows the light in the stowed position, and FIG. 1*b* shows the light in the "in-use" position. A housing assembly 10 is connected to a 2 inch female side-release buckle 12 on mounting posts 30 with a bolt 14 and a nut 15. A cable 16 transmits power between buckle 12 and housing assembly 10. It is fitted into a groove 28 on buckle 12, and passes through a hole 29 in a housing body 11. Six white, 5 mm LEDs 18 are mounted in housing assembly 10. Semi-translucent side panels 20 are mounted to housing body 11.

Figure 2:
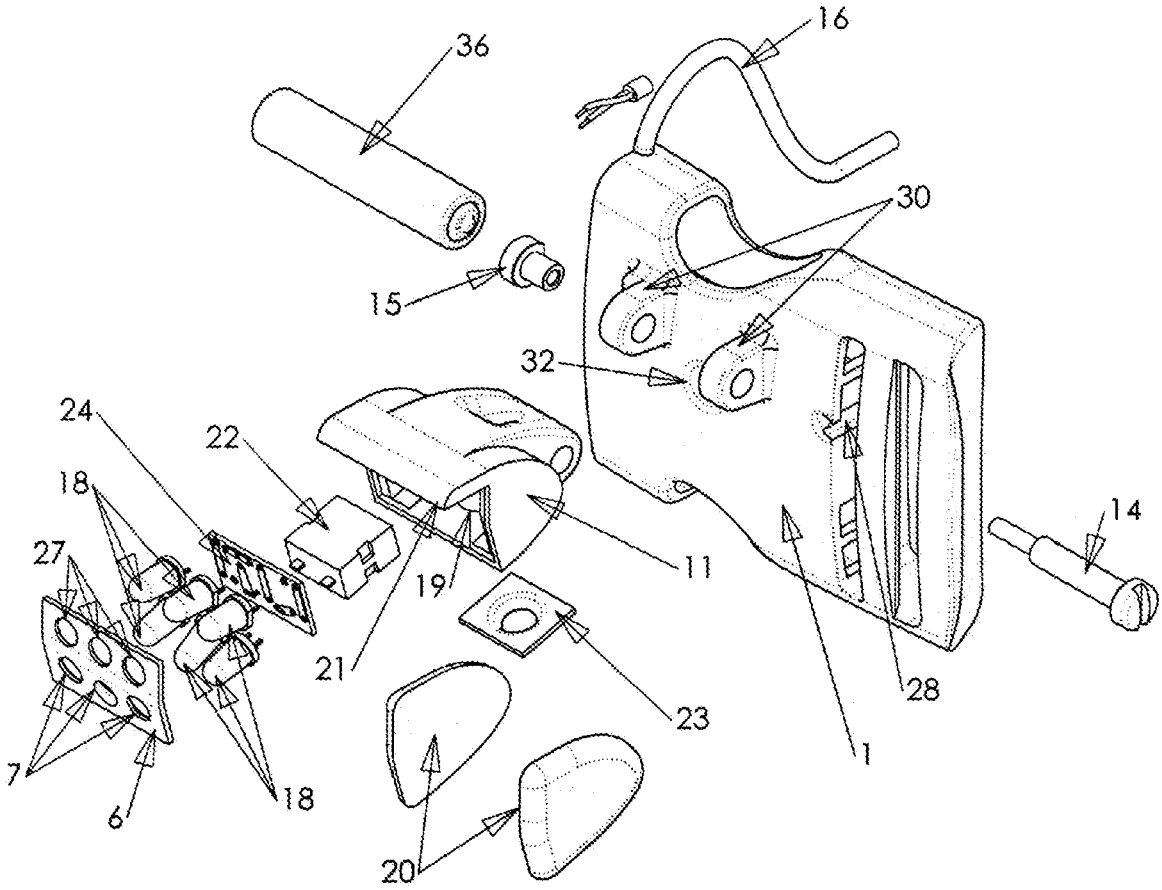
FIG. 2 shows an exploded view of the light of FIG. 1*a*.

FIG. 2 is an exploded view of the light assembly. The housing assembly 10 consists of housing body 11 with an opaque protrusion 21, a rubber button 23 protecting a switch 22, a circuit board 24, LEDs 18, a front panel 26, and side panels 20. Switch 22, cable 16, and LEDs 18 are soldered to circuit board 24. LEDs 18 fit through holes 27 in panel 26. Panel 26 is mounted to housing body 11. Button 23 is held in place between switch 22 and a hole 19 in housing body 11. A recess 32 is cut into buckle 12 so there is no interference with button 23 when light is in stowed position. A battery 36 is mounted in the center of buckle 12.

Housing body 11 and front panel 26 are made out of a durable polymer, such as polycarbonate or ABS, and may be injection molded. Rubber button 23 can be made out of natural or synthetic rubber, such as Santoprene®. Side panels 20 are made out of a semi-translucent material, such as Plexiglas® or polycarbonate. Battery 36 is a standard AAA battery, and may be either disposable or rechargeable. Buckle 12 is made from a durable polymer, such as nylon, and may be injection molded.

Figure 3:
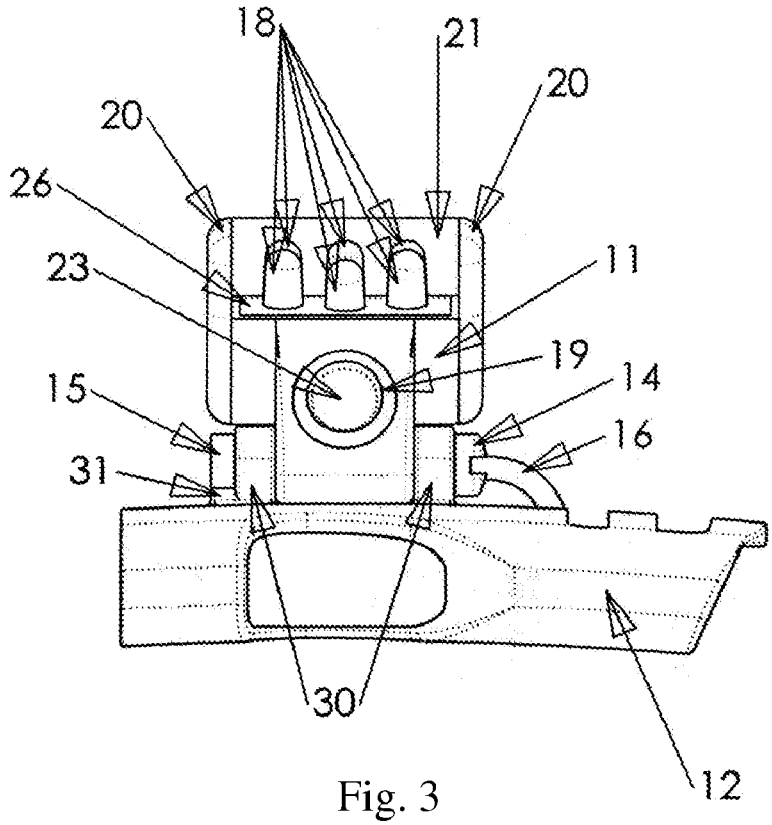
FIG. 3 shows a bottom aspect of the light of FIG. 1*a*.

FIG. 3 shows a bottom aspect of the light assembly, showing location of hole 19 and button 23.

Figure 4:
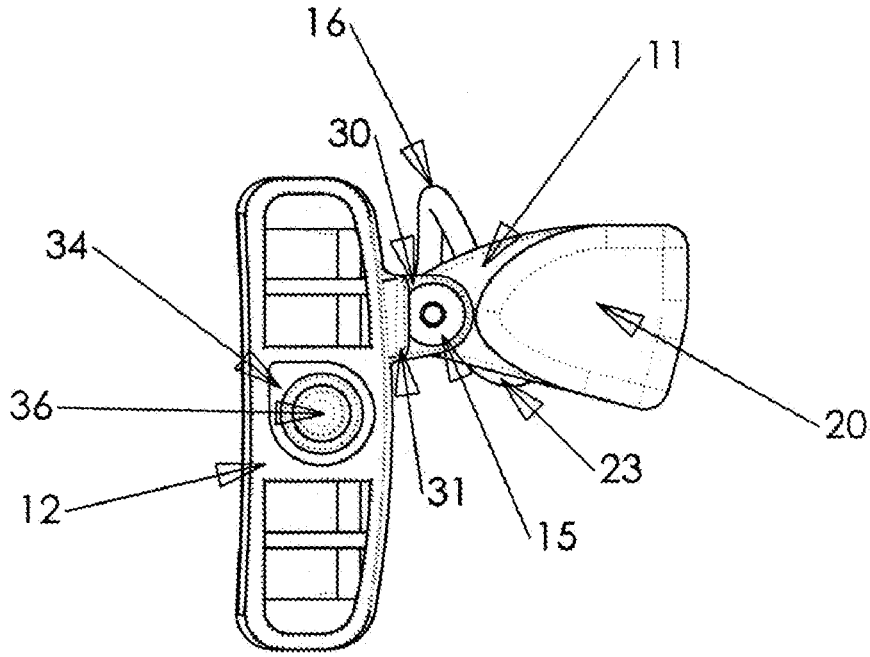
FIG. 4 shows a side aspect of the light of FIG. 1*a*.

FIG. 4 shows a side aspect of the light assembly, showing a cavity 34 in buckle 12 where battery 36 is mounted. Button 23 protrudes below the bottom of housing body 11 as shown. Nut 15 interferes with a protrusion 31 on mounting post 30 to prevent rotation.

Figure 5A:
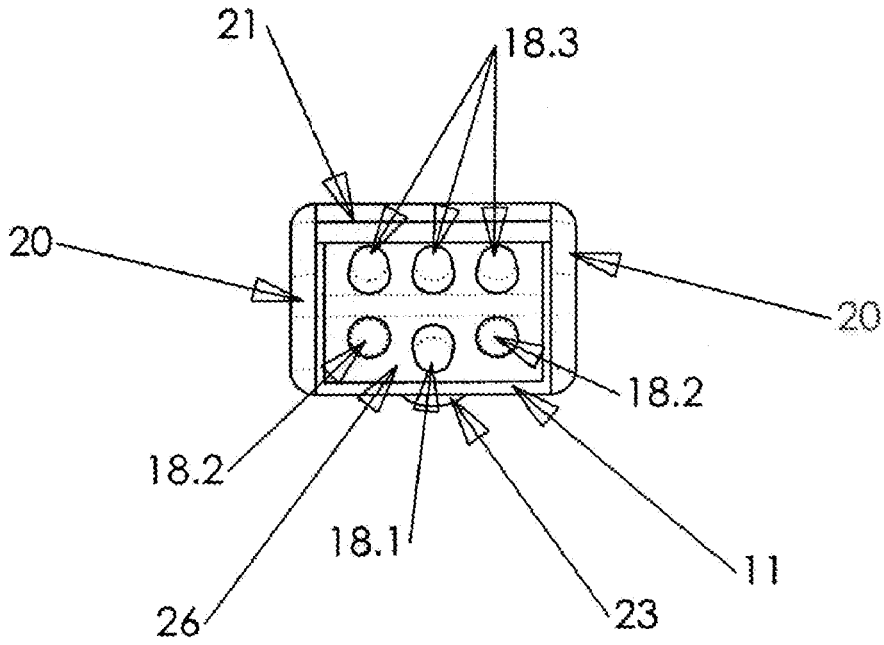
FIG. 5*a* shows a front aspect of a housing.
Figure 5B:
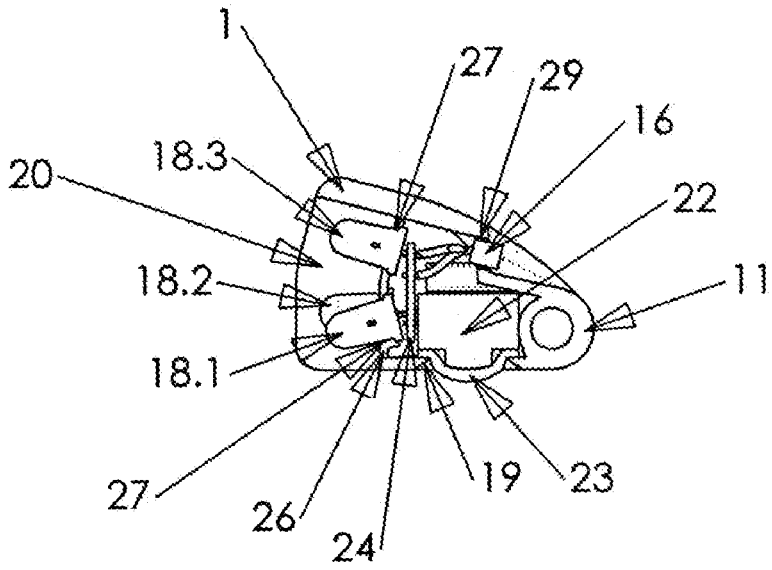
FIG. 5*b* shows a sectional view of the housing of FIG. 5*a*.
Figure 6A:
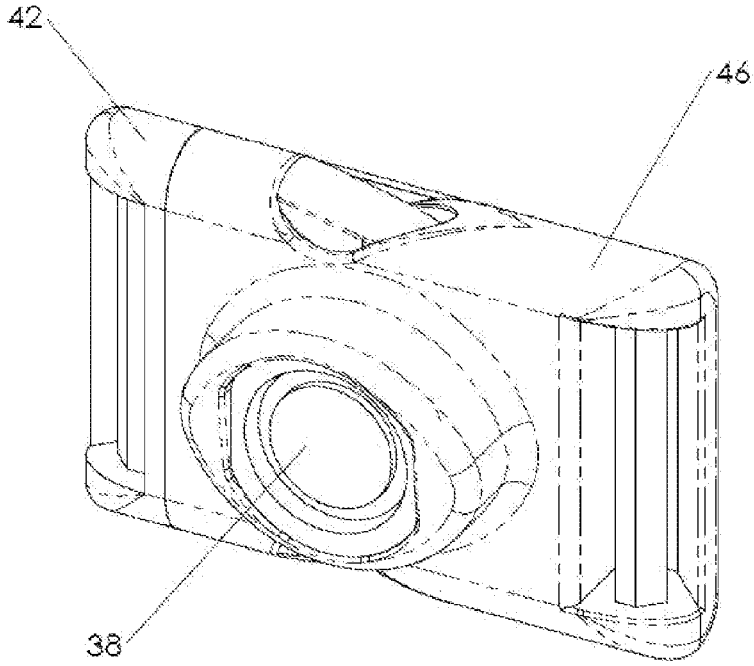
FIGS. 6*a*-6*d* show various aspects and exploded views of a second embodiment of a light with single, embedded, high-powered LED.
Figure 6B:
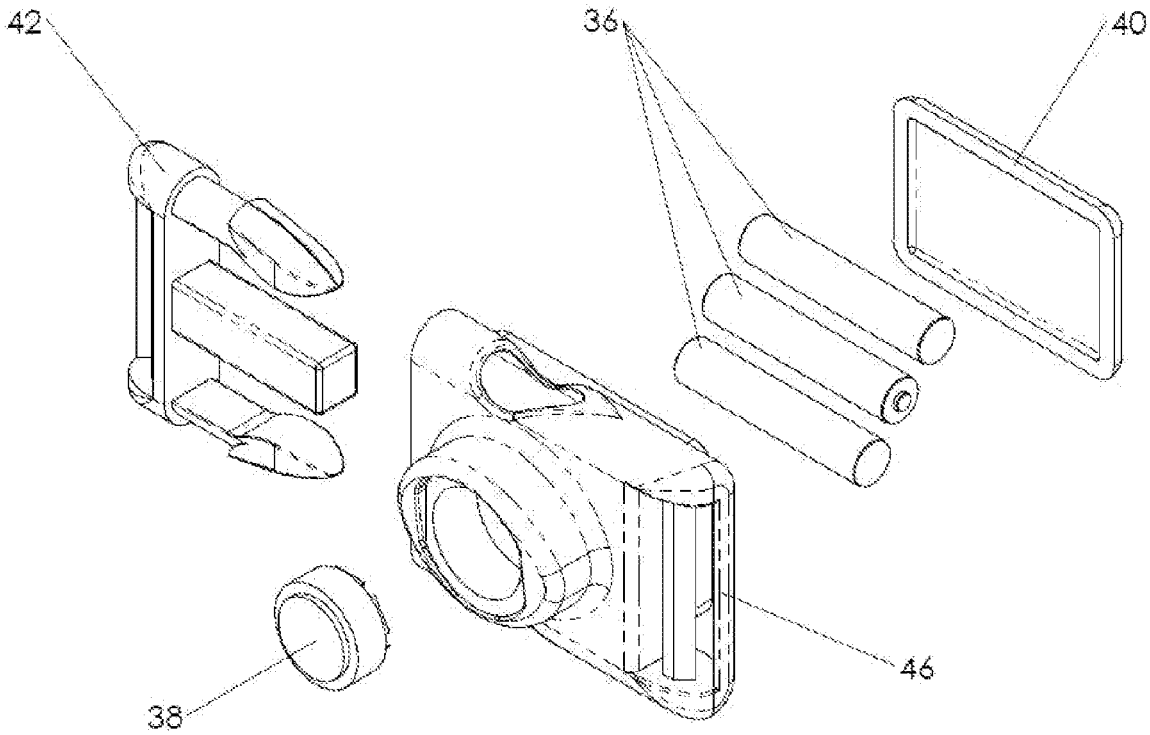
Figure 6C:
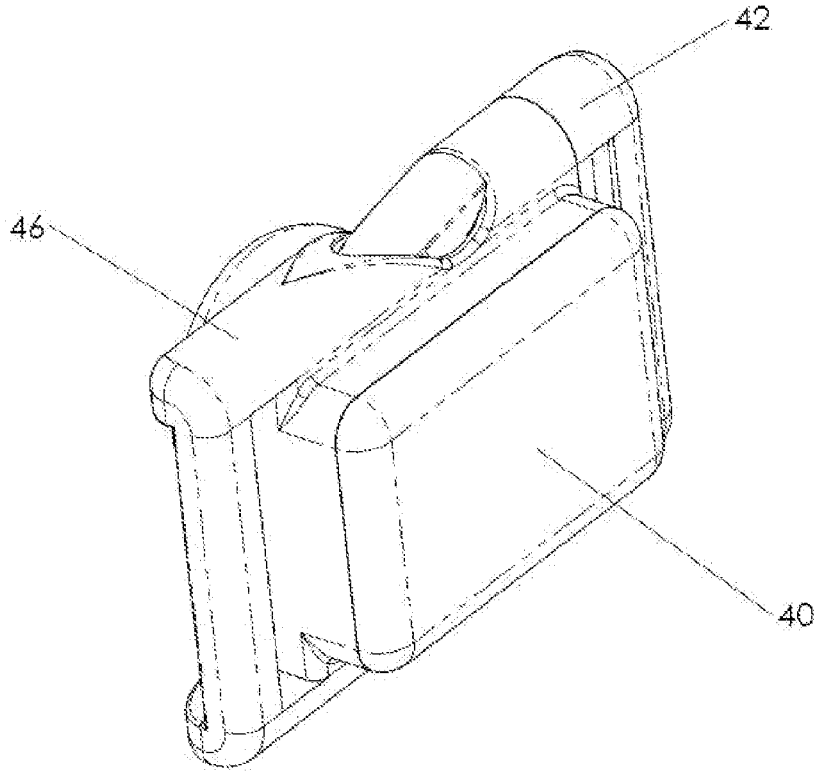
Figure 6D:
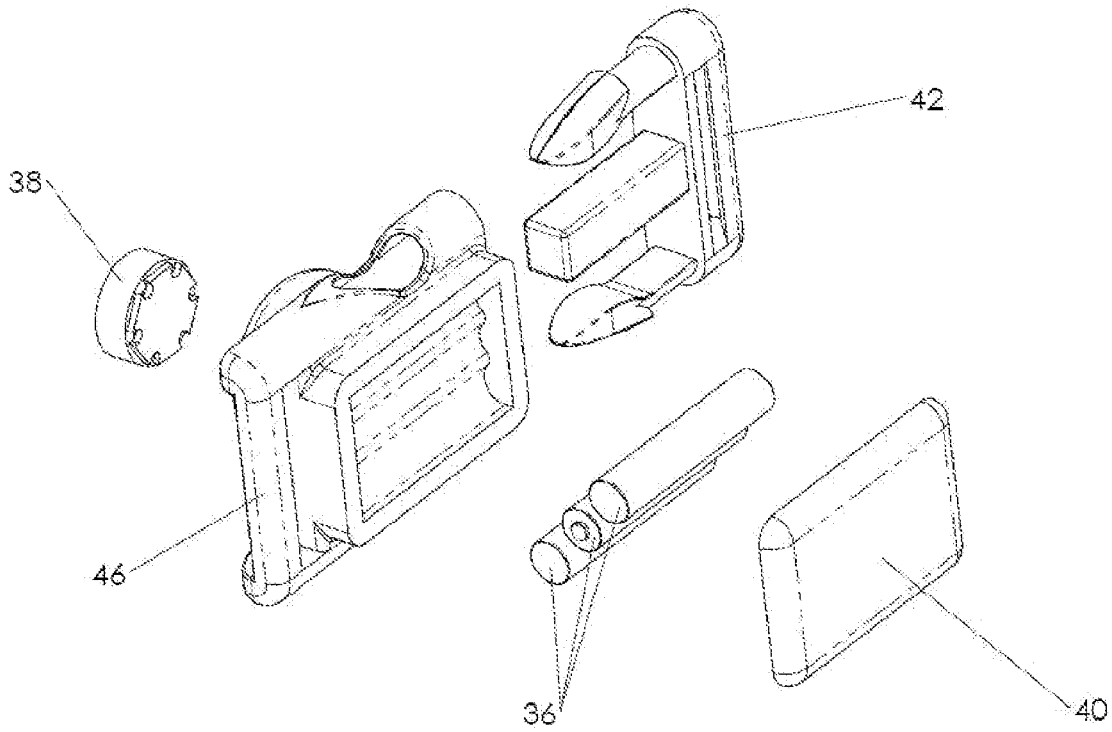

FIG. 5*a* is a front view of housing assembly 10. FIG. 5*b* is a sectional side view of housing assembly 10, showing arrangement of components within housing assembly 10. FIGS. 5*a* and 5*b* show orientations of LEDs 18 relative to a plane defined by the bottom of housing body 11. 1 LED 18.1 is mounted at an angle of approximately 15 degrees down from the plane. 2 LEDs 18.2 are mounted approximately level with the plane. 3 LEDs 18.3 are mounted at an angle 15 degrees up from the plane.

OPERATION

A user of this device would install female buckle 12 and male counterpart onto hipbelt of pack or onto piece of webbing or other strap going around user's waist. User would keep housing assembly 10 in the stowed position (FIG. 1) during the day or whenever the light was not in use. When the user needs illumination in front of him or her, the user simply moves the housing assembly 10 into the "in-use" position (FIG. 2). If user finds light in the exploded position (FIG. 3), user has done something wrong.

When the light is in the "in-use" position, the user would actuate switch 22 by pressing on button 23, thus turning on or off the light. Recess 32 protects button 23 when housing assembly 10 is in the stowed position, preventing light from accidentally getting turned on. Before use, user would insert battery 36 into buckle 12. When battery 36 is drained, user removes and replaces battery 36.

If housing assembly is not staying in position, user tightens bolt 14. Nut 15 cannot rotate, so only one tool is needed for this adjustment. Tightening bolt 14 moves mounting posts 30 closer together, increasing pressure on housing body 11, preventing housing assembly 10 from falling down.

Semi-translucent panels 20 are mounted on the side of housing body 11 to limit the amount of light escaping the side. During normal use, user's hands move within close proximity to LEDs. Due to this close proximity, user's hands will become very bright without panels 20, distracting use and adversely affecting user's night vision. Panels 20 will limit the brightness of the light, yet still allow for illumination to the side of the user.

Opaque protrusion 21 shields a user's direct view of LEDs 18. By design, LEDs 18 have an intense bright spot at the foremost point in the lens. Without opaque protrusion 21, user would have a direct view of this intense bright spot, significantly and adversely affecting user's night vision. Protrusion 21 blocks substantially all light from direct view by user, allowing user to develop better night vision. This allows the user to see more around him or her, and makes the light on the trail appear brighter, increasing its effective brightness.

DETAILED DESCRIPTION—ADDITIONAL EMBODIMENTS

FIGS. 6*a*-6*d* show various aspects and exploded views of a second embodiment of a light with one fixed, embedded 1W LED. A 1W LED 38 is embedded in a female side-release buckle 46. LED 38 is powered by either a single or a plurality of AAA batteries 36 which are contained in buckle 46 and enclosed by a battery cover 40.

Figure 7A:
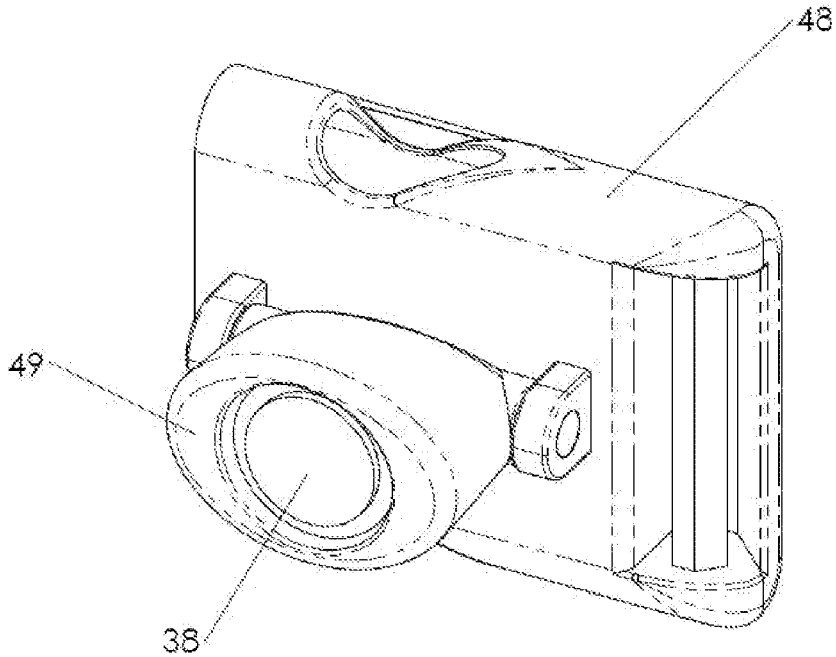
FIGS. 7*a* & 7*b* show isometric and exploded views of a third embodiment of a light with a single, high-powered LED and a movable housing.
Figure 7B:
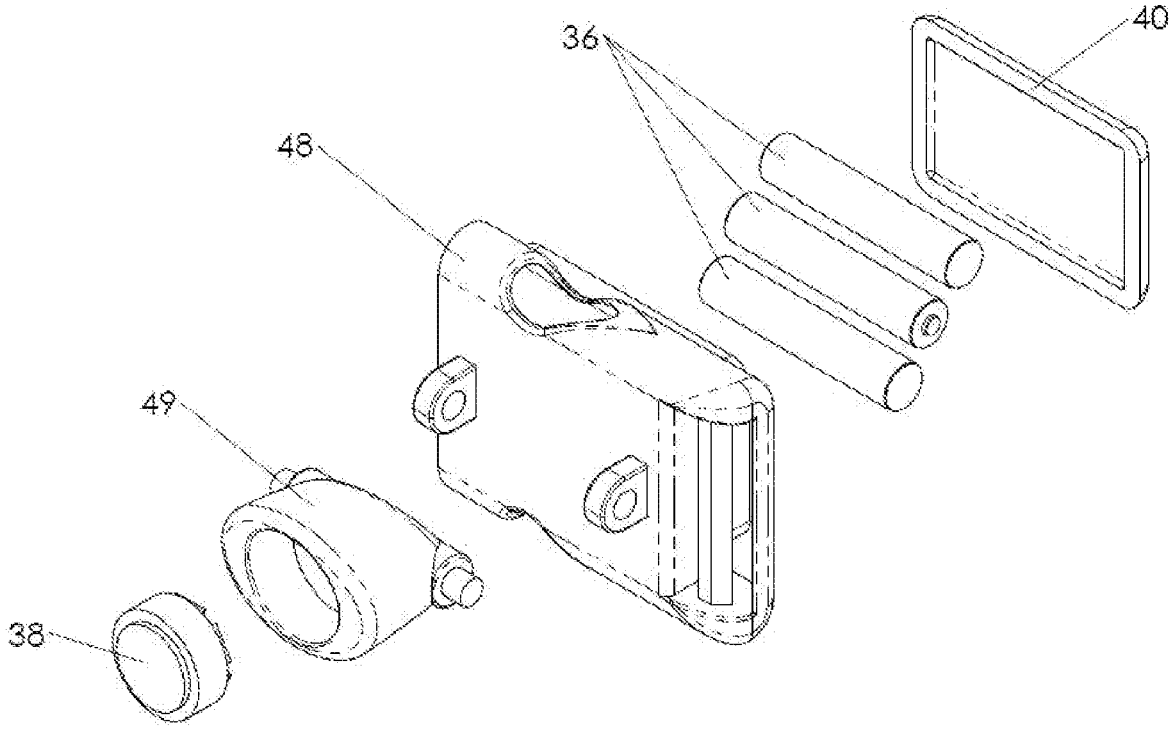

FIGS. 7*a*-7*b* show isometric and exploded views of a third embodiment of a light with one 1W LED in an adjustable housing. LED 38 is embedded in a swivel housing 49, which is attached to a female side-release buckle 48. Throughout the specification and claims, the term "attached" is meant to be interpreted broadly and includes affixing to as well as integral to. Housing 49 is vertically adjustable relative to buckle 48 to direct light where it is desired. Power from batteries 36 to LED 38 is transmitted either by the method described above in the preferred embodiment or as described below.

Figure 8A:
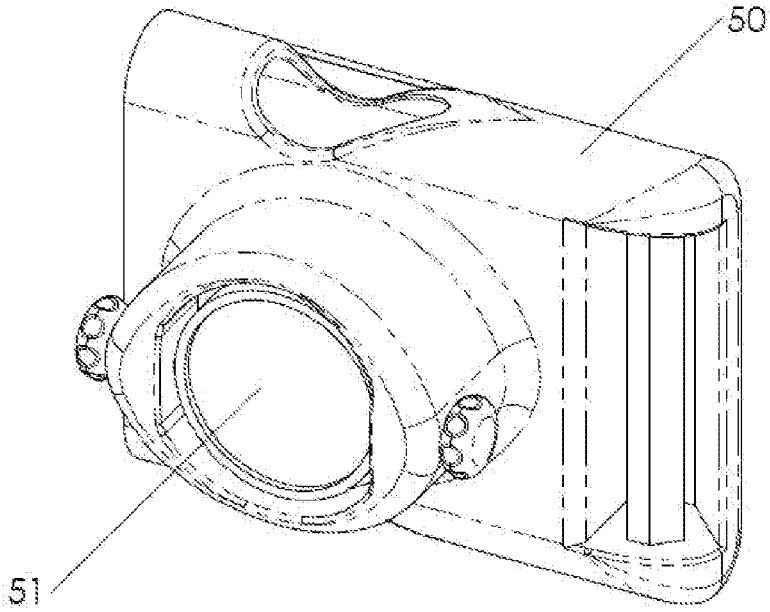
FIGS. 8*a* & 8*b* show isometric and exploded views of a fourth embodiment of a light with a swivel lens.
Figure 8B:
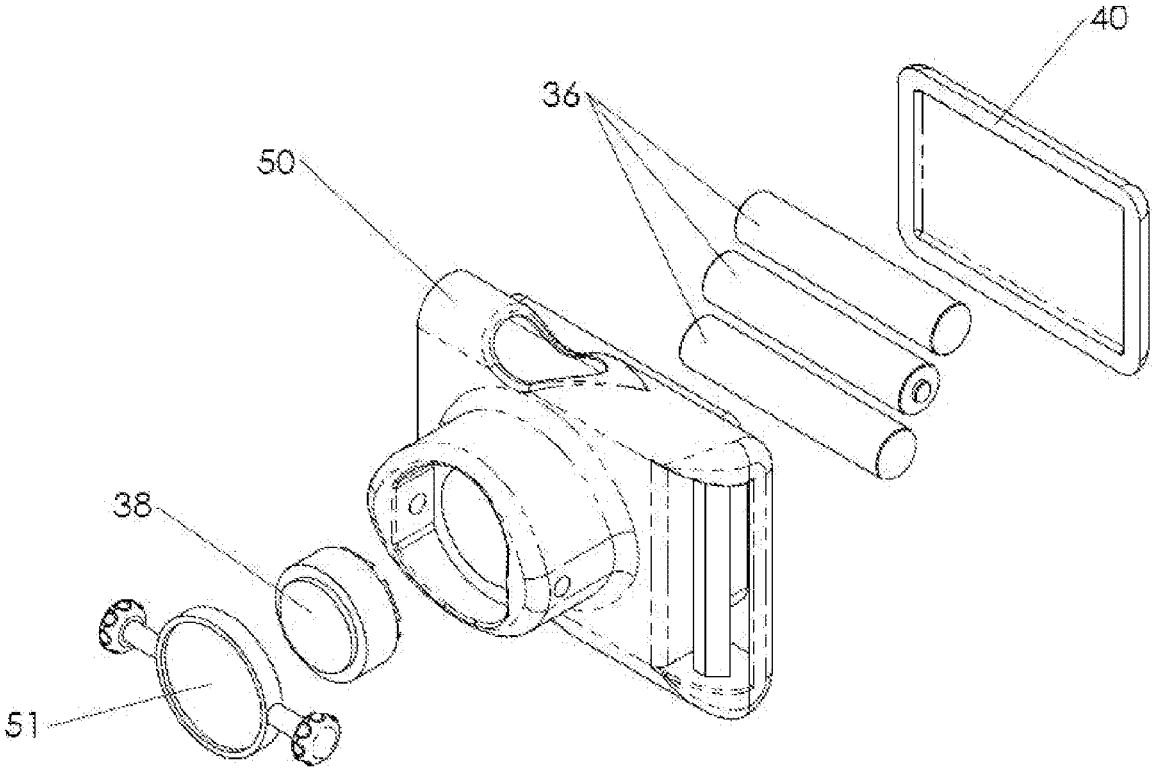

FIGS. 8*a*-8*b* show isometric and exploded views of a fourth embodiment of a light with one fixed, embedded 1W LED with an adjustable lens. LED 38 is embedded in a female side-release buckle 50. A swivel lens 51 is attached in front of LED 38, and rotates vertically to direct light.

Figure 9A:
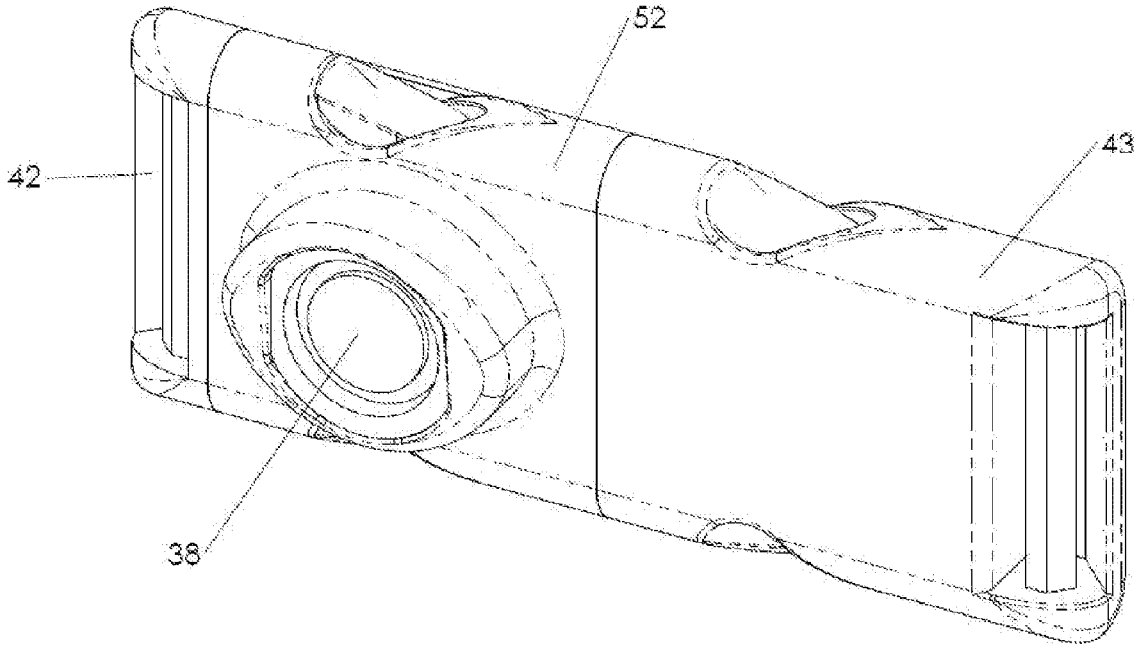
FIGS. 9*a* & 9*b* show isometric and exploded views of a fifth embodiment of a light embedded in a different buckle.
Figure 9B:
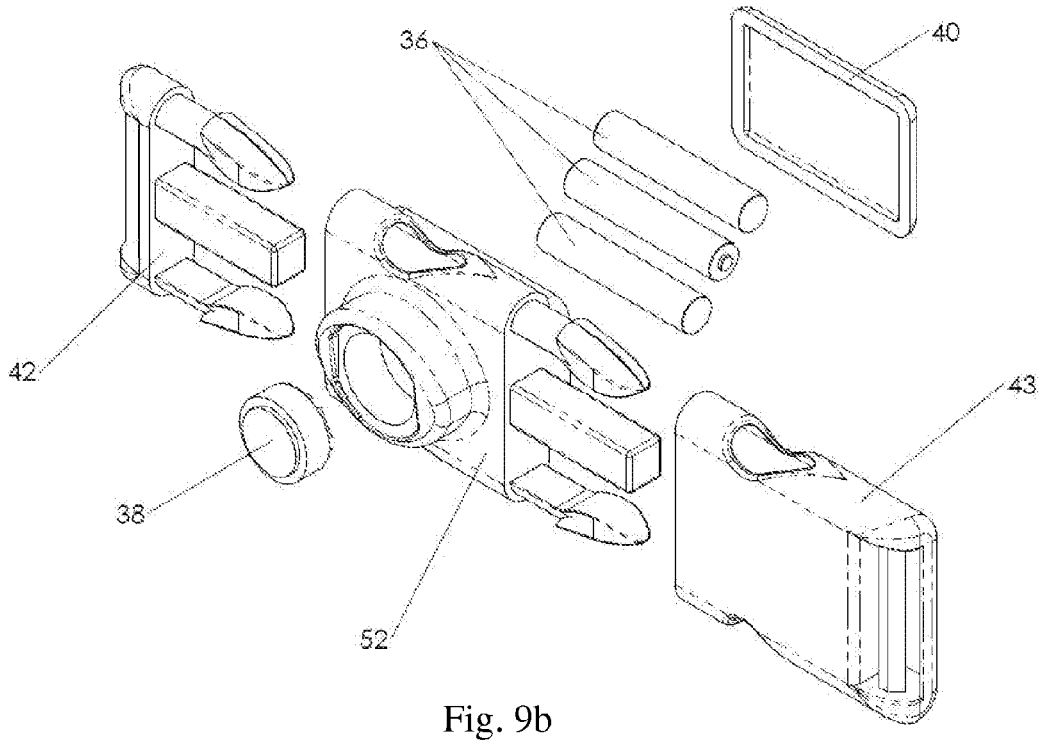

FIGS. 9*a*-9*b* show isometric and exploded view of a fifth embodiment of a light with one fixed, embedded 1W LED. LED 38 is embedded in a female side-release buckle 52 with male protrusions. Buckle 52 mates with a plain female buckle 43.

In FIGS. 6-9, LED 38 is powered by a plurality of AAA batteries 36, which are contained in the respective buckles (46, 48, 50, 52) and enclosed with a battery cover 40. The respective female buckles (46, 48, 50, 52) mate with male buckle 42.

ADVANTAGES

Figure 10:
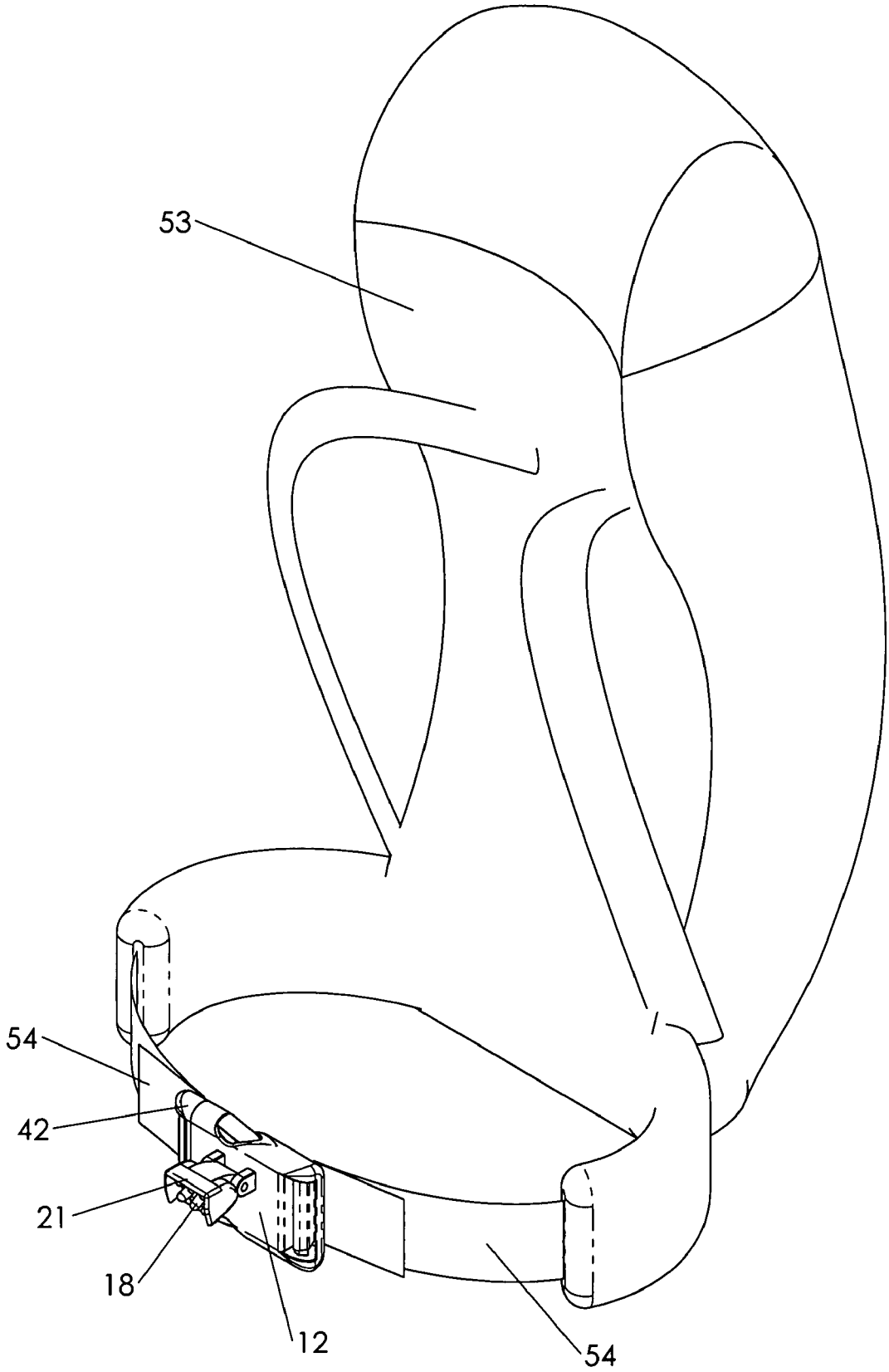
FIG. 10 shows an isometric view of the device attached centrally to a hip belt strap of a backpack.

FIG. 10 shows an isometric view of the preferred embodiment attached centrally to a hip belt strap of a backpack. Female side-release buckle 12 is mounted on a hip belt strap 54. Male buckle 42 is mounted on a second hip belt strap 54. Hip belt straps 54 are attached to a backpack 53. Opaque protrusion 21 prevents light emitted by LEDs 18 from extending upward in the direction of users eyes.

From the description above, a number of advantages of my buckle-mounted light become evident:

a) By mounting a light on a buckle (such as a hip-belt buckle), the light is moved away from the eyes, enabling the user to see shadows, thereby increasing depth perception at night.

b) By mounting a light on a buckle, the light is a significant distance from the user's nose and mouth, eliminating the temporary blindness from light reflecting off the condensation in a users breath described above.

c) The light is hands-free, without the consequences of a headlamp.

d) The buckle is always in the same place on the pack, so the user always knows where the light is. The possibility of forgetting or losing the light, or not being able to find it in the dark is greatly reduced, if not essentially eliminated.

e) The light will be centered on the user's waist, due to the position of the buckle.

CONCLUSION, RAMIFICATIONS, AND SCOPE

Accordingly, the reader will see that the buckle-mounted light of this invention provides superior illumination when hiking at night. The visibility of shadows allows for depth perception that was previously unavailable with headlamps. This greatly increases the user's enjoyment and safety of the activity. Also, the difficulty in misplacing the light is a distinct advantage.

Although the description above contains many specificities, these should not be construed as limiting the scope of the invention but as merely providing illustrations of some of the presently preferred embodiments of this invention. For example:

a) LEDs could be set to flash as a safety light.

b) Buckle could be smaller or larger.

c) Buckle could be a different size than the webbing which it is attached to.

d) Battery(s) could be mounted elsewhere in the buckle (such as proximal to where the strap is threaded).

e) Battery(s) could be mounted inside housing assembly.

f) More or fewer batteries could be used.

g) Other battery sizes, configurations, or chemistries could be used, such as AA or lithium ion.

h) More or fewer LEDs could be used.

i) LED arrangement could be different, either by changing the angles, changing the number of angles, or changing the number of LEDs directed in each angle.

j) Buckle could be mounted on sternum strap instead of hip-belt or waist-strap.

k) Cable 16 could be eliminated, instead using housing mounting posts 20 for electricity transmission. Such a mechanism could be accomplished with a cup-and-ball system.

l) Housing assembly could be detachable.

m) If housing assembly was detachable, a harnessing assembly could be made for mounting assembly on head for chores around camp.

n) If housing assembly was detachable, batteries could be mounted inside housing assembly, or in buckle using the housing mounting posts for electricity transmission.

o) Housing posts could have grooves or ridges that would interact with ridges or grooves on the housing assembly, giving discreet positions for the housing relative to the buckle.

p) Other light sources, such as, but not limited to, 3W LED(s) or incandescent bulb(s), could be used instead of the 5 mm or 1W LEDs.

q) The light could be mounted on the male member of the buckle, or the buckle could be unisex.

Thus the scope of the invention should be determined by the appended claims and their legal equivalents, rather than by the examples given.

I claim:

1. A device for illuminating a user's path, comprising:

a buckle comprising a first member and a second member, each configured for attaching a strap thereto, a housing attached to the buckle containing a light source, and a power source attached to said buckle and electrically connected to the light source, such that said light source produces sufficient lumens to illuminate objects proximal to user and is directed outwardly from device, whereby the user can mount said device onto a hip-belt of a backpack.

2. The device according to claim 1, wherein the housing is pivotally attached to the buckle and configured to illuminate an area in front of a user based upon the position the housing is pivoted to.

3. The device according to claim 1 wherein said light source is a single high-powered light-emitting diode.

4. The device according to claim 1 wherein said light source is a plurality of light-emitting diodes.

5. The device according to claim 1 further comprising:

a first semi-translucent panel on a side of the light source, and a second semi-translucent panel on an opposite side of the light source, wherein the first and second semi-translucent panels are configured to limit the amount of light escaping to the sides of the light source.

6. The device according to claim 1 further comprising:

an opaque protrusion which is configured to shield a user's direct view of the light source, whereby the user's night vision is not affected by the direct view.

7. The device according to claim 1 wherein said light source can be set to a flashing mode.

8. A device for illuminating a user's path, comprising:

a buckle comprising a first member and a second member, each configured for attaching a strap thereto, a light source embedded within said buckle, and a power source attached to said buckle and electrically connected to said light source, such that said light source produces sufficient lumens to illuminate objects proximal to user and is directed outwardly from device, whereby the user can mount said device onto a hip-belt of a backpack.

9. The device according to claim 8 further comprising a lens pivotably mounted to the buckle forward of said light source, said lens having a longitudinal axis of rotation and configured to direct light generated by said light source in a vertical plane.

10. The device according to claim 8 wherein said light source includes a single high-powered light-emitting diode.

11. The device according to claim 8 wherein said light source includes a plurality of light-emitting diodes.

12. The device according to claim 8 further comprising:

a first semi-translucent panel on a side of the light source, and a second semi-translucent panel on an opposite side of the light source, wherein the first and second semi-translucent panels are configured to limit the amount of light escaping to the sides of the light source.

13. The device according to claim 8 further comprising:

an opaque protrusion which is configured to shield a user's direct view of the light source, whereby the user's night vision is not affected by the direct view.

14. The device according to claim 8 wherein said light source can be set to a flashing mode.

15. A device for illuminating a user's path, comprising:

a side-release buckle comprising a male member and a female member, each configured to attach a strap thereto, a middle member comprising a female receptacle configured to engage said male member, and male protrusion configured to engage said female member, a light source embedded within said middle member, and a power source attached to said middle member and electrically connected to said light source, such that said light source produces sufficient lumens to illuminate objects proximal to user and is directed outwardly from device, whereby the user can mount said device onto a hip-belt of a backpack.

16. The device according to claim 15 wherein said light source includes a single high-powered light-emitting diode.

17. The device according to claim 15 wherein said light source includes a plurality of light-emitting diodes.

18. The device according to claim 15 further comprising:

a first semi-translucent panel on a side of the light source, and a second semi-translucent panel on an opposite side of the light source, wherein the first and second semi-translucent panels are configured to limit the amount of light escaping to the sides of the light source.

19. The device according to claim 15 further comprising:

an opaque protrusion which is configured to shield a user's direct view of the light source, whereby the user's night vision is not affected by the direct view.

20. The device according to claim 15 wherein said light source can be set to a flashing mode.

* * * * *